US006074677A

United States Patent [19]

Croft

[11] Patent Number: 6,074,677

[45] Date of Patent: Jun. 13, 2000

[54] TUBULAR CONTAINER HAVING VACUUM PACKED INNER BAG

[75] Inventor: Robert J. Croft, Jersey City, N.J.

[73] Assignee: Recot, Inc., Pleasanton, Calif.

[21] Appl. No.: 09/152,885

[22] Filed: Aug. 28, 1998

[51] Int. Cl.[7] ..... B65D 3/10

[52] U.S. Cl. ..... 426/124; 426/87; 426/112; 220/62.18; 220/62.21; 206/524.8

[58] Field of Search ..... 426/124, 112, 426/106, 87; 220/62.21, 62.18; 206/524.8, 591, 521, 499, 92, 94

[56] References Cited

U.S. PATENT DOCUMENTS 3,225,954 12/1965 Herrick et al. ..... 220/9
3,610,455 10/1971 Greehalgh ..... 215/12
4,122,791 10/1978 Bronn ..... 113/121 C
4,298,627 11/1981 Rains ..... 426/637
4,466,553 8/1984 Zenger ..... 220/461
5,628,404 5/1997 Hendrix ..... 206/524.8

*Primary Examiner*—Curtis Sherrer
*Assistant Examiner*—Hao Mai
*Attorney, Agent, or Firm*—Rothwell, Figg, Ernst & Kurz, P.C.

[57] ABSTRACT

A vacuum packed food container has a vacuum packed inner bag and a clear or transparent outer container body. The inner bag within the container body has a food product therein. The food product is preferably a food chip, such as a potato chip or a masa based chip. A lid is detachably connected to the container body. The lid covers an opening that leads to the interior of the inner bag. The inner bag has a vacuum therein that draws the bag against the food product therein. When the lid is detached from the container body, the vacuum within the inner container is released while the vacuum in an air space around the inner bag is maintained such that the inner bag expands outward by atmospheric pressure entering the inner bag and moves towards the inner surface of the outer container body.

10 Claims, 2 Drawing Sheets

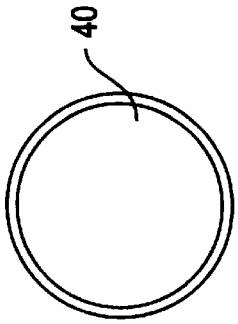
FIG. 2A
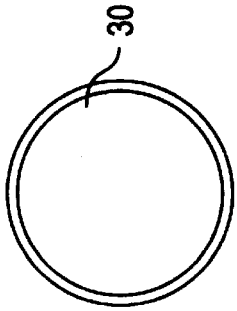
FIG. 2B
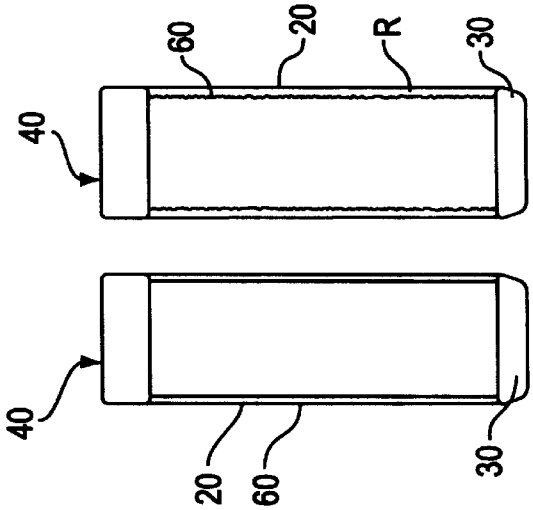
FIG. 3A
FIG. 3B
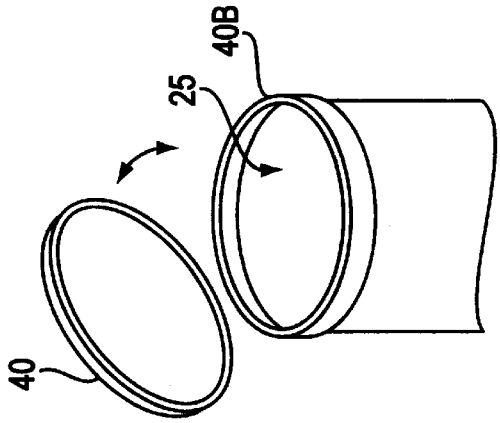
FIG. 2C
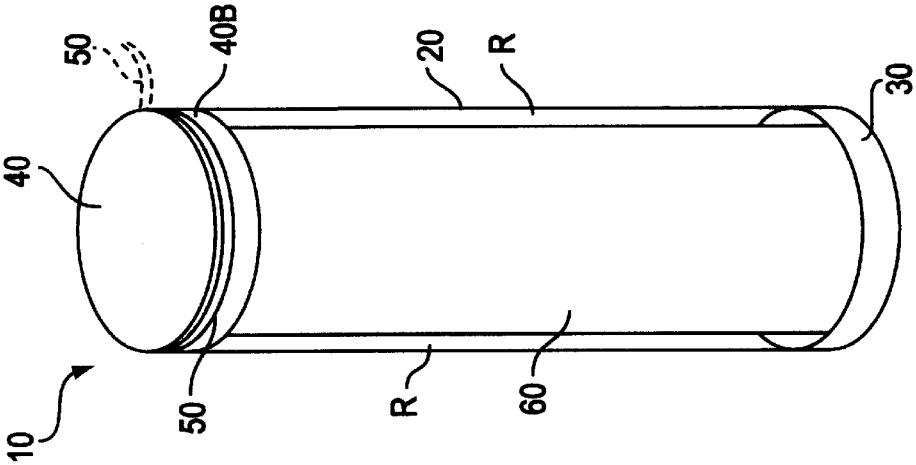
FIG. 1

TUBULAR CONTAINER HAVING VACUUM PACKED INNER BAG

BACKGROUND OF THE INVENTION

1. Field of the Invention

The present invention relates generally to containers for storing food products and the like. The present invention most particularly relates to containers for food chips such as potato chips, masa based chips and the like.

2. Description of the Background Art

There are a great variety of containers known for the storage of food products. There are also a large number of bags and containers for storing potato chips and other snack chips known in the art. As one example, it has been known in the art to place potato chips in elongated tubular cartons having a removable lid, such as for example cartons of Pringles® brand potato chips by Procter & Gamble.

Despite the many types of containers known in the food industry, there still remains a continued need for new and improved food containers.

SUMMARY OF THE INVENTION

The present invention overcomes the-above and other problems in existing food containers. The present invention also provides a unique container structure that is visually appealing and enjoyable for consumers to use and handle.

According to a first aspect of the invention, a vacuum packed food container is provided which has: a) an outer container body having a clear or transparent portion; b) an inner bag within the container body having a food product therein; c) a lid detachably connected to the container body, the lid covering an opening that leads to the interior of the inner bag; d) the inner bag having a vacuum therein that draws the bag against the food product therein; e) an air space between the outside of the inner bag and an inside surface of the outer container body, the air space having a vacuum therein; f) when the lid is detached from the container body, the vacuum within the inner container is released while the vacuum in the air space remains and whereby the inner bag expands outward by atmospheric pressure towards the inner surface of the outer container body.

Preferably, the outer container body is generally tubular and the lid is at one end of the tubular container body.

Preferably, the lid is detachable from the outer container body via a tear-strip or tear-string.

Preferably, the food product is a food chip, and, more preferably, a potato chip or a masa based chip.

According to another aspect of the invention a method of containing a food product and releasing the food product for consumption by a user is provided which includes the steps of: i) providing a vacuum packed food container, having: a) an outer container body having a clear or transparent portion; b) an inner bag within the container body having a food product therein; c) a lid detachably connected to the container body, the lid covering an opening that leads to the interior of the inner bag; d) the inner bag having a vacuum therein that draws the bag against the food product therein; e) an air space between the outside of the inner bag and an inside surface of the outer container body, the air space having a vacuum therein; ii) detaching the lid from the container body such that the vacuum within the inner container is released while the vacuum in the air space remains such that the inner bag visibly expands outward by atmospheric pressure towards the inner surface of the outer container body.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the detailed description given hereinbelow and the accompanying drawings which are given by way of illustration only, and are not limitative of the present invention, and wherein:

FIG. 1 is an top perspective view of a container according to a first embodiment of the invention;

FIG. 2(A) is a top view of the container shown in FIG. 1;

FIG. 2(B) is a bottom view of the container shown in FIG. 1;

FIG. 2(C) is a perspective view of the top of the container shown in FIG. 1 with the lid removed;

FIG. 3(A) is a side view of the container shown in FIG. 1 after a vacuum in the inner bag has been released;

FIG. 3(B) is a side view of the container shown in FIG. 1 with a vacuum still remaining in the inner bag;

DETAILED DESCRIPTION OF THE PREFERRED EMBODIMENTS

Figures 4A, 4B, 4C:
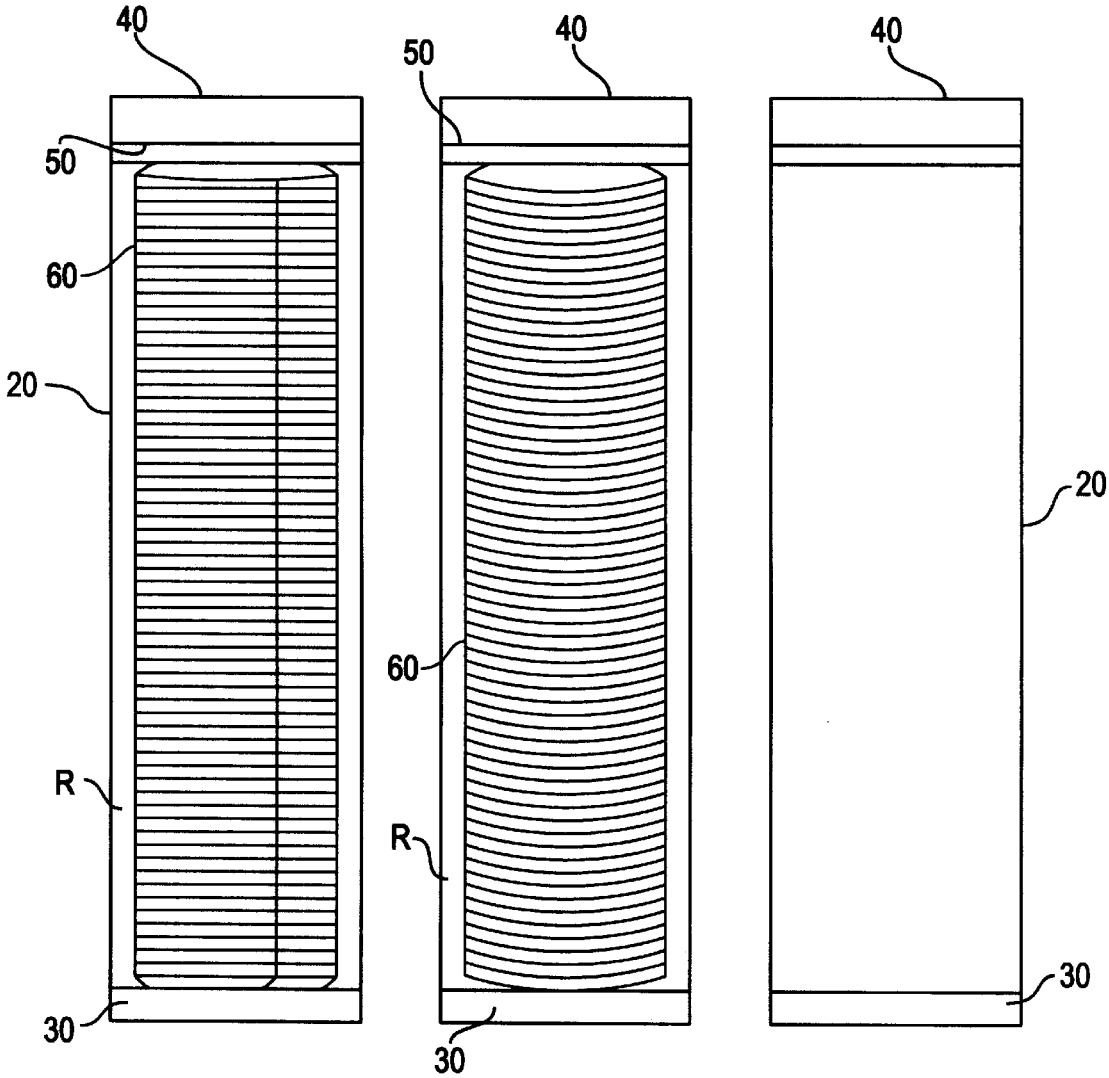
FIG. 4(A) is a side view of a container similar to that shown in FIG. 1 having an inner vacuum sealed bag containing a stack of rectangular food chips.
FIG. 4(B) is a side view of a container similar to that shown in FIG. 1 having an inner vacuum sealed bag containing a stack of generally circular food chips.
FIG. 4(C) is a side view of a container similar to that shown in FIG. 4(C) without an inner bag or other contents therein.

FIG. 1 shows a preferred embodiment of a container 10 according to the present invention. Although a preferred shape and structure of the container is shown, it is contemplated that a variety of other shapes and configurations can be used in other embodiments.

In this preferred embodiment, the container 10 has an elongated tubular center section 20, a bottom 30, and a removable cap or lid 40. The tubular center section 20 is preferably entirely clear or transparent to enable a user to see inside the container. Although less preferred, only a portion (e.g., a window or the like) of the section 20 can be clear or transparent. Preferably, the section 20 is made of a rigid transparent plastic, but other materials can also be used.

A tear-strip 50 is preferably provided for disengaging the cap 40 from the container. Other known means for disconnecting a cap from a container can also be used. The cap 40 should, however, provide a sufficiently air-tight seal prior to disconnecting the cap 40 in order to operate properly (see below).

An inner bag 60 is located within the container 10. The inner bag 60 has contents therein, preferably food contents, in a vacuum packed state. The inner bag 60 is preferably a flexible material that can collapse around the contents therein upon the application of a vacuum therein. The inner bag can be, for example, a polymeric material or a foil material. If desired, the inner bag can be clear, or it can be opaque or colored, or it can include writing or illustrations thereon.

As shown in FIGS. 4(A) and 4(B), the contents inside the inner bag 60 preferably include food chips, such as potato chips, masa based chips, or the like chips that are stacked vertically on top of one another within the bag 60 (the horizontal lines shown illustrate spaces between adjacent chips). The chips can have generally rectangular, square, or triangular shapes (see, e.g., FIG. 4(A)) or generally oval or circular shapes (see, e.g., FIG. 4(B)). Other chip shapes can also be used as desired.

In operation, a user grasps the container 10 and removes the cap 40, such as via a tear-strip or tear string 50. The inner bag 60 has a top opening aligned with the top opening 25 under the cap 40. The inner bag is preferably sealed around its top opening to either the perimeter wall of the tubular section 20 proximate the cap or to a cap base 40B below the cap 40. As a result, when the cap 40 is removed, the interior of the inner bag 60 can be accessed through the top opening 25. In this regard, when the cap 40 is removed the interior of the bag 60 should be exposed to the atmospheric air, while the region R between the inner bag 60 and the inside surface of the tubular section 20 is preferably maintained sealed from the atmospheric air.

Upon removal of the cap 40 and communicating the interior of the bag 60 with the atmospheric air, the atmospheric force upon the inner bag 60 moves the bag 60 outward towards the inner surface of the tubular section 20. Preferably, the bag 60 moves outward until it contacts the inner surface of the tubular section 20 substantially around the entire bag 60. In this manner, a user can easily observe the bag 60 expand toward the inner surface of the section 20 upon breaking the inner seal under the cap 40. This creates a very interesting and enjoyable container.

If desired, the inner bag 60 can have pictures, writing or the like thereon that are better viewed (more plainly seen) upon expansion. For example, the bag 60 can be initially crumpled around the contents therein and upon releasing the pressure therein, the bag can expand outward and assume a relatively smooth outer shape adjacent or against the inner surface of the section 20. As a result, writing or the like thereon can be more readily viewed upon expansion.

In order to facilitate outward movement of the inner bag 60 upon the breakage of the seal under the cap 40, a vacuum is also preferably provided in the region R. In this manner, upon opening, the atmospheric pressure entering the bag 60 will be greater than that in the region R so that the bag 60 will readily expand. It should be understood that the initial vacuum in the region R is preferably substantially less than the vacuum in the bag 60 so that the bag 60 does not pull away from the contents therein prior to releasing the cap 40. That is, there should be a sufficient differential between the vacuum in the bag 60 and the vacuum in the region R so that the vacuum in the region R does not overcome the vacuum in the inner bag 60.

The invention being thus described, it will be apparent to those skilled in the art that the same may be varied in many ways without departing from the spirit and scope of the invention. Any and all such modifications are intended to be included within the scope of the following claims. As some examples, the shape of the container can vary greatly, and the present invention can be used to contain any type of product, including non-food products.

What is claimed is:

1. A vacuum packed food container, comprising:

a) an outer container body having a clear or transparent portion;

b) an inner bag within said container body having a food product therein;

c) a lid detachably connected to said container body, said lid covering an opening that leads to the interior of said inner bag;

d) said inner bag having a vacuum therein that draws the bag against the food product therein;

e) an air space between the outside of said inner bag and an inside surface of said outer container body, said air space having a vacuum therein;

f) when said lid is detached from said container body, said vacuum within said inner container is released while said vacuum in said air space remains and whereby said inner bag expands outward by atmospheric pressure towards the inner surface of said outer container body.

2. The vacuum packed food container of claim 1, wherein said outer container body is generally tubular and said lid is at one end of said tubular container body.

3. The vacuum packed food container of claim 1, wherein said outer container body is generally cylindrical and said lid is at one end of said cylindrical container body.

4. The vacuum packed food container of claim 1, wherein said lid is detachable from said outer container body via a tear-strip or tear-string.

5. The vacuum packed food container of claim 1, wherein said inner bag includes writing or pictures thereon that are better viewed upon releasing the vacuum inside the inner bag by way of the inner bag assuming a smoother outer shape closer to the inner surface of said outer container body.

6. The vacuum packed food container of claim 1, wherein said food product is a food chip.

7. The vacuum packed food container of claim 6, wherein said food chip is a potato chip or a masa based chip.

8. A method of containing a food product and releasing the food product for consumption by a user, comprising the steps of:

i) providing a vacuum packed food container, having:

a) an outer container body having a clear or transparent portion;

b) an inner bag within said container body having a food product therein;

c) a lid detachably connected to said container body, said lid covering an opening that leads to the interior of said inner bag;

d) said inner bag having a vacuum therein that draws the bag against the food product therein;

e) an air space between the outside of said inner bag and an inside surface of said outer container body, said air space having a vacuum therein;

ii) detaching said lid from said container body such that said vacuum within said inner container is released while said vacuum in said air space remains such that said inner bag visibly expands outward by atmospheric pressure towards the inner surface of said outer container body.

9. The method of claim 8, wherein said food product is a food chip.

10. The method of claim 9, wherein said food chip is a potato chip or a masa based chip.

* * * * *